US005141060A

United States Patent [19]

Jogi

[11] Patent Number: 5,141,060

[45] Date of Patent: Aug. 25, 1992

[54] METHOD FOR OPTIMIZING OF STABILIZER POSITIONING IN A BOTTOMHOLE ASSEMBLY TO ELIMINATE THE EFFECTS OF BOREHOLE INCLINATION

[75] Inventor: Pushkar N. Jogi, Portland, Conn.

[73] Assignee: Teleco Oilfield Services Inc., Meriden, Conn.

[21] Appl. No.: 430,529

[22] Filed: Nov. 1, 1989

[51] Int. Cl.[5] ..... E21B 7/08

[52] U.S. Cl. ..... 175/45; 175/61; 175/73; 175/325.5; 364/422

[58] Field of Search ..... 364/422; 175/45, 61, 175/57, 40, 24, 27, 73, 76, 325

[56] References Cited

U.S. PATENT DOCUMENTS

| | | | |
|---|---|---|---|
| 4,015,673 | 4/1977 | Craig, Jr. et al. | 175/76 |
| 4,456,080 | 6/1984 | Holbert | 175/61 |
| 4,667,751 | 5/1987 | Geczy et al. | 175/76 |
| 4,807,708 | 2/1989 | Forrest et al. | 175/325 X |
| 4,848,488 | 7/1989 | Cendre et al. | 175/325 X |
| 4,874,045 | 10/1989 | Clayton | 175/325 X |
| 4,995,466 | 2/1991 | Snow, Jr. | 175/325 X |

OTHER PUBLICATIONS

N. P. Callas et al, "Solution of Exact Equation by Analog Computer", Oil & Gas Journal, Dec. 29, 1980, pp. 186-190.

P. N. Jogi et al, "Predicting the Build/Drop Tendency of Rotary Drilling Assemblies", SPE Drilling Engr., Jun. 1988, pp. 177-186.

N. P. Callas et al, "Boundary Value Problem is Solved", Oil & Gas Journal, Dec. 15, 1980, pp. 62-66.

*Primary Examiner*—Stephen J. Novosad

*Attorney, Agent, or Firm*—Fishman, Dionne & Cantor

[57] ABSTRACT

A method is presented for designing a bottomhole assembly whose tendency to build/drop or hold angle is independent of borehole inclination. This method comprises the adjustment of the location of any one of the first three stabilizers of an arbitrarily selected bottomhole assembly while the location of the remaining stabilizers is left in position. In accordance with the present invention, at one particular location of the stabilizer which has been selected to be moved, the resulting build/drop or hold rate of the bottomhole assembly is independent of borehole inclination.

11 Claims, 4 Drawing Sheets

METHOD FOR OPTIMIZING OF STABILIZER POSITIONING IN A BOTTOMHOLE ASSEMBLY TO ELIMINATE THE EFFECTS OF BOREHOLE INCLINATION

BACKGROUND OF THE INVENTION

This invention relates generally to a technique for optimizing stabilizer positioning in a bottomhole assembly or BHA. More particularly, this invention relates to the optimization of stabilizer positioning in a BHA so as to eliminate the effects of borehole inclination.

It is well known that numerous factors determine the behavior of a BHA. Some of the more important of these factors include:

1. BHA design, i.e., stabilizer location and size as well as collar size
2. Borehole inclination and curvature
3. Borehole size
4. Weight on Bit (WOB)
5. Rotations per minute (RPM)
6. Bit and stabilizer side cutting
7. Formation dip and anisotropy Typically, a majority of rotary bottomhole assemblies for directional control are designed through practical experience and trial and error. This approach can produce satisfactory results when a great deal of local experience can be drawn on. However, in drilling new areas, the use of trial and error can prove costly because of the increased number of trips and correction runs. Mathematical models are known for predicting the directional inclination tendencies of rotary assemblies which are helpful in limiting the uncertainty associated with the traditional BHA design techniques. Most of these mathematical models are two dimensional and static. Examples of these mathematical models are described in Walker, B. H. and Frieman, M. B.: "Three-Dimensional Force and Deflection Analysis of a Variable Cross Section Drillstring", J. Pressure Vessel Tech. (May 1977) 367-73; Murphy, C. E. and Cheatham J. B. Jr.,: "Hole Deviation and Drill String Behavior", SPEJ (March 1966) 44-49; Trans., AIME, 237; Callas, N. P. and Callas, R. L.: "Stabilizer Placement," Oil and Gas J. (Nov. 24, 1980) 142-52; (Dec. 1, 1980) 140-55; (Dec. 29, 1980) 186-90; Jogi, P. N., Burgess, T. M., and Bowling J. P.: "Predicting the Build/Drop Tendency of Rotary Drilling Assemblies," SPEDE (June 1988).

While the above described mathematical models primarily take into account Items 1-4 as discussed above, discrepancies do occur due to:

1. Dynamical effects of rotary speed (Item 5)
2. Changes in hole size due to bit and stabilizer side cutting, hole washout and mechanical erosion (Item 6)
3. Changes in hole inclination because of formation dip and anisotropy (Item 7)

If dynamical effects due to RPM are ignored, then for a given BHA design, a given weight-on-bit and a given mud weight, the BHA response is only dependent on hole inclination, formation dip and changes in borehole size. Therefore, if the hole angle dependency is eliminated from the above list, any discrepancy in the results will then be a function of only the hole size changes (Item 6) and dip angle changes (Item 7). Since as mentioned, the majority of rotary bottomhole assemblies are designed using practical experience and trial and error, and since response of all assemblies is dependent on borehole inclination, assemblies must be changed more often. This problem would be alleviated if a method could be found for designing a BHA which eliminates the effect of borehole inclination.

SUMMARY OF THE INVENTION

The above discussed and other problems and deficiencies are overcome or eliminated by the method and technique of the present invention wherein optimization of stabilizer positioning in a bottomhole assembly is utilized to eliminate the effects of borehole inclination. In accordance with the present invention, a technique is provided for designing a BHA such that its build/drop rate response is the same for all borehole inclinations. This technique requires a known software program which can compute either the bit side force or the build/drop rate for a given bottom hole assembly. The computed numerical value of the build/drop or hold rate of the assembly remains unchanged if the position of either one of the first three stabilizers is relocated in accordance with a procedure described in more detail hereinafter.

In accordance with the present invention, a BHA may be constructed which will have a known build/drop or hold rate which is independent of borehole inclination. As a result, and if the hole size remains theoretically constant, only one BHA will be needed to go to a particular target. Of course, this would result in large cost savings in terms of tripping times.

In addition, since in general the BHA response is more sensitive to hole size changes than to dip changes, a dipping bed will cause an overall change in inclination of the borehole depending upon the magnitude of dip. An increase in hole size will, however, always cause an overall dropping tendency in a bottomhole assembly response proportional to the hole size. Therefore, the method of the present invention would then be a direct indicator of hole size changes and may be used to develop a pseudo caliper log.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

In accordance with the present invention, a technique is provided for designing a bottom hole assembly such that its build/drop rate response is the same for all borehole inclinations. This technique requires a software program which can compute either the bit side force or the build/drop rate for a given bottom hole assembly. Such software programs have been developed and are used by many in the industry. These software programs are based on the models described in detail in the articles previously cited in the background section. An example of one such computer program which computes bit side force is disclosed on pages 186-190 of Oil and Gas Journal, Dec. 29, 1980. In accordance with the present invention, it has been found that the computed numerical value of the build/drop or hold rate of the BHA remains unchanged if the position of either one of the first three stabilizers is relocated in accordance with the following procedure. In reviewing this procedure, reference should be made to any one of FIGS. 1, 2 or 3 which describe, for example only, a BHA having four stabilizers spaced along the lower 105 feet of the drill string. In each of the examples of FIGS. 1-3, the weight-on-bit has been set at 40 thousand pounds and the mud weight has been made constant at 10 ppg.

Several assumptions that are used in the derivation of the mathematical models described in the Background section are as follows:

1. The components of the drillstring behave elastically.
2. The bit is centered in the borehole on the hole axis, and no moment exists between the bit and the formation.
3. The borehole walls are rigid.
4. The drillstring and drilling fluid dynamic effects are ignored.
5. The drillstring lies on the low side of the borehole for some finite interval above the last stablizer.
6. The displacement from the hole axis is small relative to the length.

Figure 1:
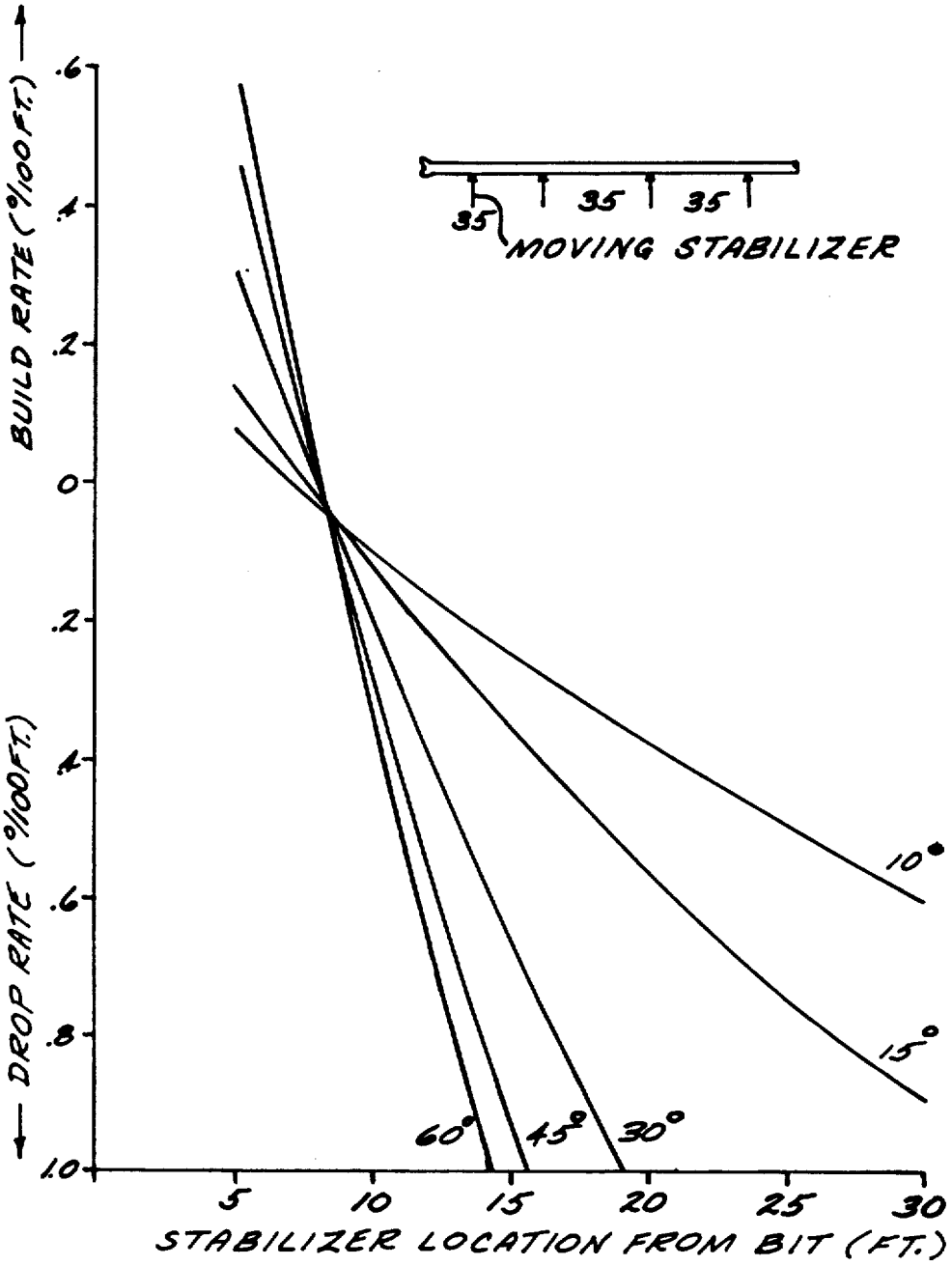
FIG. 1 is a graph depicting the effect of stabilizer location on the build/drop rate for a first BHA design.
Figure 2:
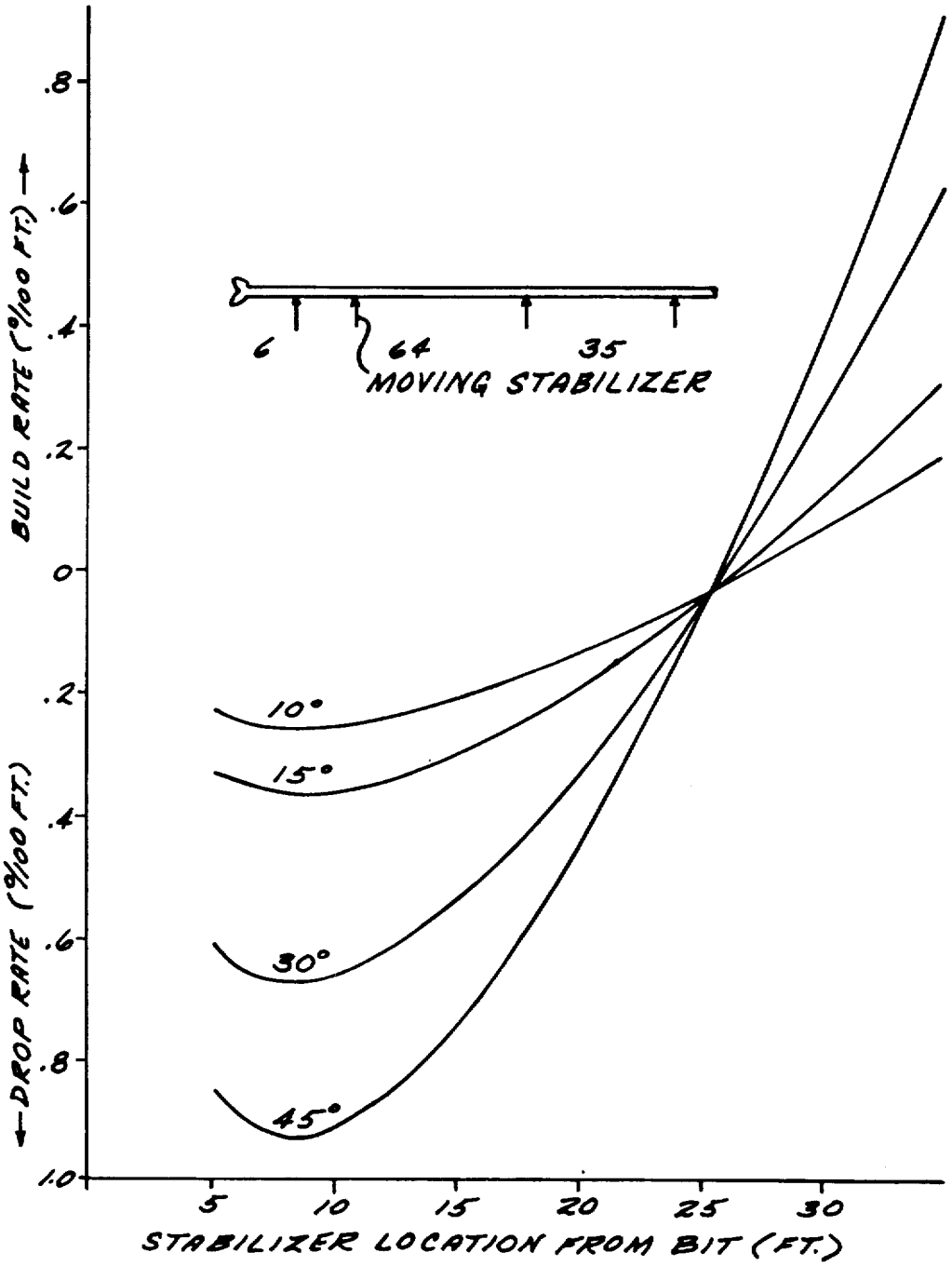
FIG. 2 is a graph depicting the effect of stabilizer location on build/drop rate for a second BHA design.

In FIG. 1, the first of the four stabilizers is moved relative to the others while in FIG. 2, the second stabilizer is moved relative to the others. Finally, in FIG. 3, the third stabilizer is moved relative to the others. The procedure of the present invention will now be described by the following steps numbered 1-9:

1. A given BHA is selected and any one of the first three stabilizers in a multistabilizer assembly is chosen to be relocated while the other stabilizers remain fixed. As mentioned, in FIG. 1 the first stabilizer is relocated while the others remain fixed. Similarly, in FIGS. 2 and 3, the second and third stabilizers respectively, are movable while the other respective stabilizers remain fixed.

2. Keeping the position of the remaining stabilizers fixed, the position of the movable stabilizer is relocated a few feet away from the nearest lower stabilizer (or the bit if the selected stabilizer to be moved is the near bit stabilizer, as in FIG. 1).

3. The above described BHA software program for determining either the bit side force or the build/drop rate for the BHA is then run using a known weight-on-bit, mud density, bit and collar size for an arbitrarily selected value of borehole inclination. As a result, the bit side force or the build/drop rate is then computed.

4. The movable stabilizer is moved in small increments until it reaches a location a few feet away from the nearest upper stabilizer. 5. At each incremental position of the stabilizer, the bit side force or build/drop rate of the resulting BHA is computed.

Figure 3:
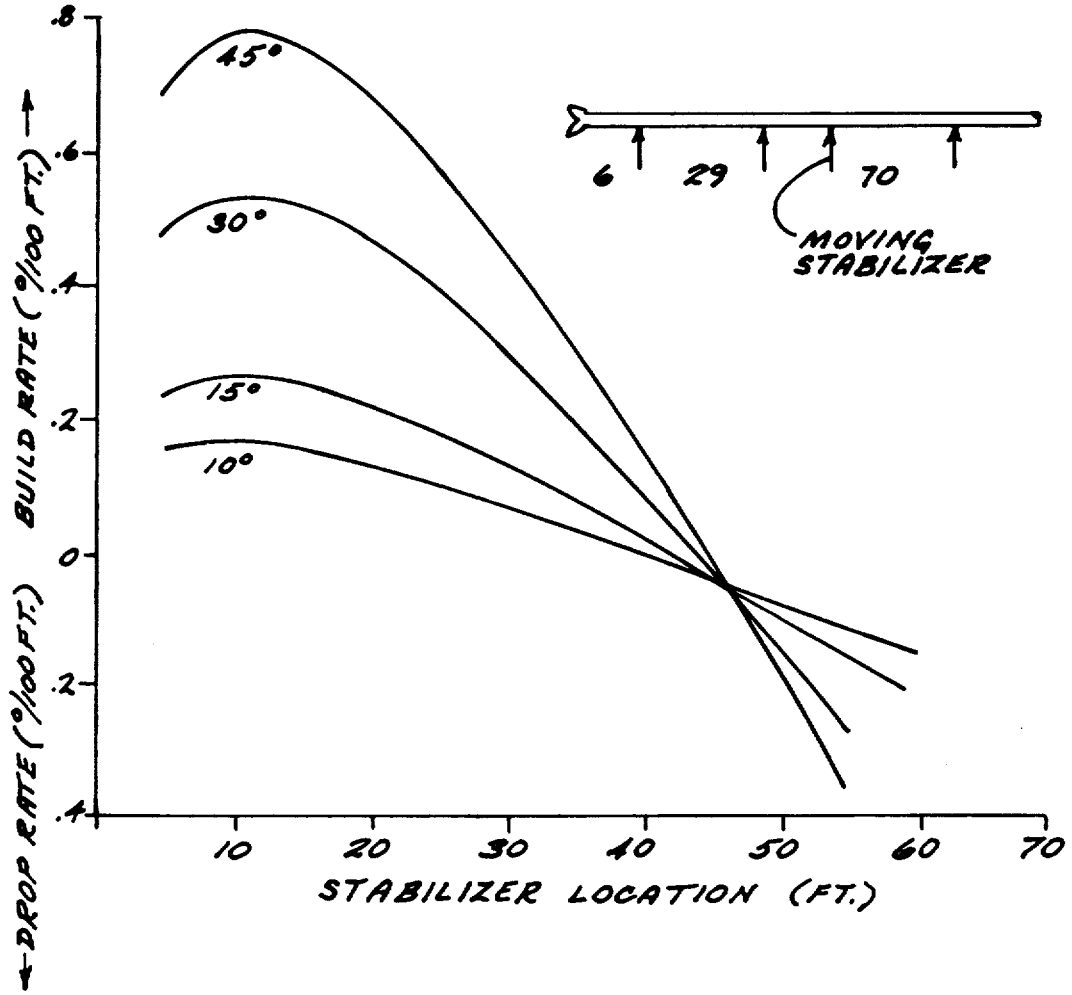
FIG. 3 is a graph depicting the effect of stabilizer location on build/drop rate for a third BHA design.

6. The bit side force or build/drop then plotted against each incremental position of the selected movable stabilizer on graph paper as shown in FIGS. 1-3.

7. Steps 1-6 are repeated for one or two more arbitrarily selected borehole inclinations.

8. As is clear from a review of FIGS. 1-3, all the plotted curves of side force or build/drop rate versus stabilizer location pass through a common intercept point for all borehole inclinations.

9. The location of this intercept point is then selected as the optimum location of the movable stabilizer.

The bottom hole assembly obtained from the graphs of FIGS. 1-3 (that is, the BHA wherein the selected stabilizer is positioned at the intercept point of the several curves) will thus provide a BHA which will have the same response for all borehole locations regardless of inclination. It will be appreciated that for all of the computations described in steps 1-9, the hole diameter is assumed to be the same as the bit size. The following conclusions may be reached when using the technique of the present invention:

1. If all of the stabilizers on the assembly selected by the above procedure are full gage, then the stabilizer location method of the present invention will provide a slightly building, holding, slightly dropping assembly for any borehole inclination. The drilling response of such a BHA is also found to be independent of weight-on-bit, for most ranges of weight on bit.

2. If the technique for the present invention is used on an assembly with the first stabilizer undergage, then the resulting BHA will drop at a constant rate for any borehole inclination. The degree of drop will depend upon the clearance between the borehole and the first stabilizer.

3. If the technique of the present invention is used on a BHA with the second stabilizer being undergage, then the resulting assembly will build at a constant rate for any borehole inclination. The degree of build will depend upon the clearance between the borehole and the second stabilizer.

The method of the present invention provides significant improvement to prior art methods of designing bottomhole assemblies which for the most part depend solely upon practical experience and trial and error. In the past, the result has been that many different bottomhole assemblies must be used in a given drilling run with the large number of trips and correction runs adding to significant costs. When using the present invention and assuming that the hole size remains constant, only one bottomhole assembly (designed using the above-described method of the present invention) would be theoretically needed to go to the target area. Of course, this would result in a large cost savings in terms of the lower number of tripping times.

If a BHA assembly is designed having a measurement-while-drilling (MWD) sub as a part thereof, then any changes in build/drop rate computed from inclination measurements will reflect changes in terms of hole size (since those changes would be independent of changes in borehole inclination). With that in mind, it will be appreciated that the method of the present invention can also be used to develop a pseudo caliper log for computing changes in hole size. Such a log may be calculated using the following formula:

$$DH = BS + C\,(R)$$

Where

DH = Computed hole size

BS = Bit size

Figure 4:
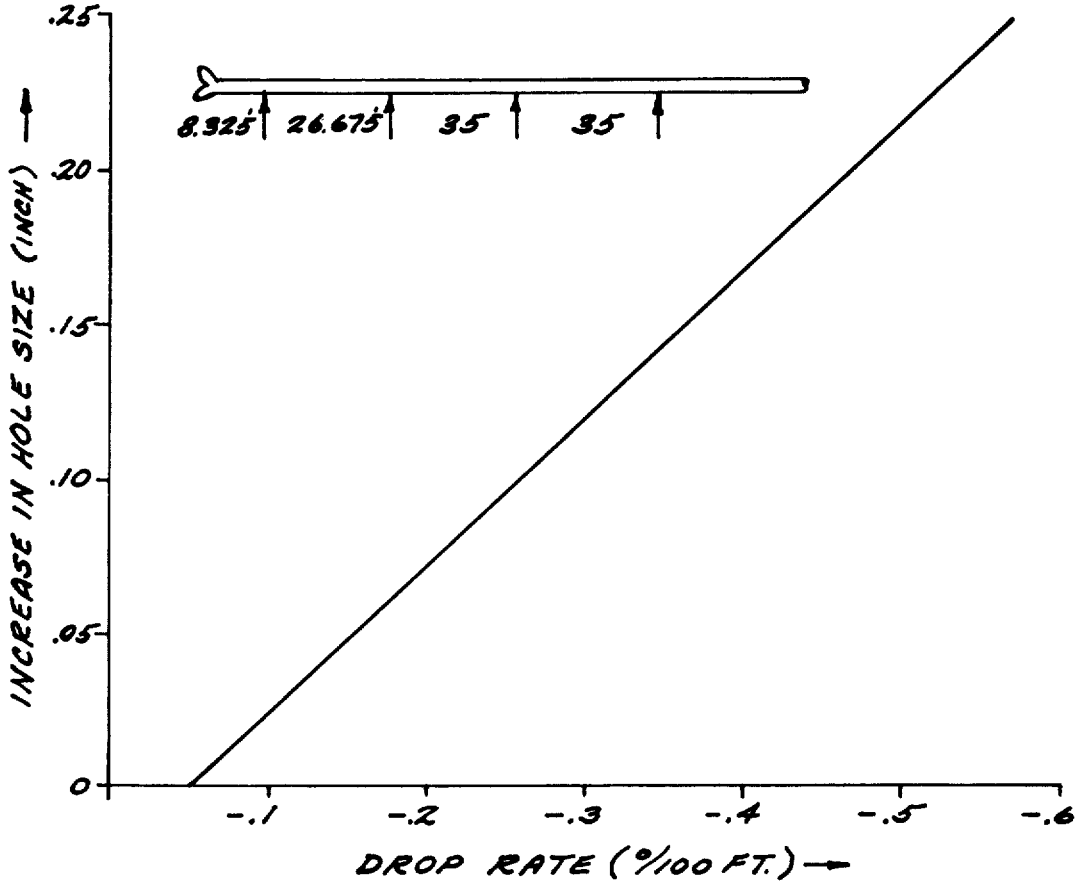
FIG. 4 is a graph depicting the effect of increase in borehole size on the build/drop rate of a BHA.

R = Observed build/drop rate obtained from sequential surveys accomplished in a known manner from the MWD sensors C = Theoretically obtained slope of the hole size versus build/drop rate curve Referring to FIG. 4, the above formula has been used to provide a graph showing the effect of the increase in hole size on the build/drop rate for an assembly designed by the above procedure. The change in drop rate is computed from inclination measurements and a change in the hole size is then calculated with reference to the graph of FIG. 4. For example, referring to FIG. 4, an observed drop rate of 0.2 degrees will indicate a change in borehole size of 0.07 inch. It will be appreciated that the graph of FIG. 4 is based on a known bit size (BS) of 12.25 inches, with constant C equal to 0.41758 and a BHA having the specific stabilizer positioning depicted in FIG. 4.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of optimizing stabilizer positioning in a multistabilizer bottomhole assembly (BHA) including at least three first stabilizers, including the steps of:

(a) selecting any one of the first three stabilizers to be a movable stabilizer and the remaining stabilizers to be fixed stabilizers;

(b) positioning the movable stabilizer at a first selected location and determining the bit side force or build/drop rate of the BHA at said first location for a first pre-selected value of borehole inclination;

(c) incrementally positioning the movable stabilizer at a plurality of other selected locations between either adjacent fixed stabilizers or between the drill bit and an adjacent fixed stabilizer and calculating the bit side force or build/drop rate of the BA at said other selected locations for said first pre-selected value of borehole inclination;

(d) plotting the calculated bit side force or build/drop rate of the BHA versus the respective selected movable stabilizer location to define a first curve;

(e) repeating steps (b), (c) and (d) for at least one second pre-selected value of borehole inclination to define a second curve;

(f) determining the intercept point of said first and second curves, said intercept point giving the corresponding optimum location of the movable stabilizer relative to the fixed stabilizers; and (g) positioning said movable stabilizer on said multistabilizer bottomhole assembly to said optimum location determined in step (f).

2. The method of claim 1 including the step of:

selecting the stabilizer of the BHA to be full gage relative to the borehole wherein said optimum location of the movable stabilizer will provide a BHA which builds slightly, drops slightly or holds for any borehole inclination.

3. The method of claim 1 including the step of:

selecting the first stabilizer to be undergage relative to the borehole wherein said optimum location of the movable stabilizer will provide a BHA which drops at a constant rate for any borehole inclination.

4. The method of claim 1 including the step of:

selecting the second stabilizer to be undergage relative to the borehole wherein said optimum location of the movable stabilizer will provide a BHA which builds at a constant rate for any borehole inclination.

5. The method of claim 1 wherein said step of determining the bit side force or build/drop rate of the BHA comprises using a computer program.

6. The method of claim 1 wherein an optimized stabilizer position is obtained using the steps of (a)-(f) and including the step of:

plotting the build rate or drop rate versus borehole size for said optimized stabilizer location to obtain a borehole size graph.

7. The method of claim 6 including the step of:

compiling a caliper log based on said borehole size graph.

8. The method of claim 6 wherein said borehole size is calculated from the following formula:

$$\text{Borehole size} = BS + C(R)$$

where

BS = bit size

R = observed build or drop rate; and

C = theoretically obtained slope of the borehole size versus build or drop rate curve.

9. A method of obtaining a borehole size graph using a multistabilizer bottomhole assembly (BHA) including at least three first stabilizers, including the steps of:

(a) selecting any one of the first three stabilizers to be a movable stabilizer and the remaining stabilizers to be fixed stabilizers;

(b) positioning the movable stabilizer at a first selected location and determining the bit side force or build/drop rate of the BHA at said first location for a first pre-selected value of borehole inclination;

(c) incrementally positioning the movable stabilizer at a plurality of other selected locations between either adjacent fixed stabilizers or between the drill bit and an adjacent fixed stabilizer and calculating the bit side force or build/drop rate of the BHA at said other selected locations for said first pre-selected value of borehole inclination;

(d) plotting the calculated bit side force or build/drop rate of the BHA versus the respective selected movable stabilizer location to define a first curve;

(e) repeating steps (b), (c) and (d) for at least one second pre-selected value of borehole inclination to define a second curve;

(f) determining the intercept point of said first and second curves, said intercept point giving the corresponding optimum location of the movable stabilizer relative to the fixed stabilizers; and (g) plotting the build rate or drop rate versus borehole size for said optimized stabilizer location determined in step (f) to obtain a borehole size graph.

10. The method of claim 9 including the step of:

compiling a caliper log based on said borehole size graph.

11. The method of claim 9 wherein said borehole size is calculated from the following formula:

$$\text{Borehole size} = BS + C(R)$$

where

BS = bit size

R = observed build or drop rate; and

C = theoretically obtained slope of the borehole size versus build or drop rate curve.

* * * * *